US008668550B1

(12) United States Patent
Sartell

(10) Patent No.: US 8,668,550 B1
(45) Date of Patent: Mar. 11, 2014

(54) PROSTHETIC NIPPLE UNDERGARMENT DEVICE

(71) Applicant: Richard B. Sartell, Waterford, MI (US)

(72) Inventor: Richard B. Sartell, Waterford, MI (US)

( * ) Notice: Subject to any disclaimer, the term of this patent is extended or adjusted under 35 U.S.C. 154(b) by 0 days.

(21) Appl. No.: 13/943,096

(22) Filed: Jul. 16, 2013

(51) Int. Cl.
*A41C 3/00* (2006.01)

(52) U.S. Cl.
USPC ..... 450/81; 450/54; 450/57; 2/267

(58) Field of Classification Search
USPC ..... 450/81, 54–58, 37, 38; 2/267, 268; 623/7, 8
See application file for complete search history.

(56) References Cited

U.S. PATENT DOCUMENTS

| | | | | |
|---|---|---|---|---|
| 3,285,247 | A | 11/1966 | Morin | |
| 3,976,083 | A * | 8/1976 | Schmidt | 450/1 |
| 4,127,128 | A | 11/1978 | Schmidt | |
| 4,199,825 | A * | 4/1980 | Knoche | 623/7 |
| 4,227,536 | A | 10/1980 | Shimenkov et al. | |
| 4,317,241 | A * | 3/1982 | Knoche | 623/7 |
| 4,333,471 | A * | 6/1982 | Nakai | 450/81 |
| D346,656 | S | 5/1994 | Rosen | |
| D388,587 | S | 1/1998 | Magidson et al. | |
| 5,782,672 | A * | 7/1998 | Woodley | 450/57 |
| 6,036,577 | A * | 3/2000 | Coburn | 450/57 |
| 6,497,609 | B1 | 12/2002 | Cobbs | |
| 6,881,123 | B1 * | 4/2005 | Klakauskas | 450/39 |
| 6,887,217 | B1 * | 5/2005 | Logan | 604/74 |
| 6,964,596 | B1 | 11/2005 | Abramyan | |
| 7,566,344 | B2 | 7/2009 | Hansen | |
| 7,621,797 | B1 * | 11/2009 | Hershkovich | 450/36 |
| 8,257,531 | B2 | 9/2012 | Laghi | |
| 8,460,233 | B2 * | 6/2013 | McCoy | 604/74 |
| 2005/0085161 | A1 * | 4/2005 | Klakauskas | 450/57 |

* cited by examiner

*Primary Examiner* — Gloria Hale

(57) ABSTRACT

A prosthetic nipple undergarment device is wearable to give an appearance of an erect nipple of a desired size and shape beneath an outer garment. The device includes a brassiere having a breast receiving cup. A prosthetic nipple is selectively coupled to the cup. The prosthetic nipple comprises a base and a projection coupled to and extending from the base wherein the prosthetic nipple is configured to resemble an erect human nipple.

9 Claims, 4 Drawing Sheets

PROSTHETIC NIPPLE UNDERGARMENT DEVICE

BACKGROUND OF THE DISCLOSURE

Field of the Disclosure

The disclosure relates to undergarment devices and more particularly pertains to a new undergarment device for giving an appearance of an erect nipple of a desired size and shape beneath an outer garment.

SUMMARY OF THE DISCLOSURE

An embodiment of the disclosure meets the needs presented above by generally comprising a brassiere having a breast receiving cup. A prosthetic nipple is selectively coupled to the cup. The prosthetic nipple comprises a base and a projection coupled to and extending from the base wherein the prosthetic nipple is configured to resemble an erect human nipple.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
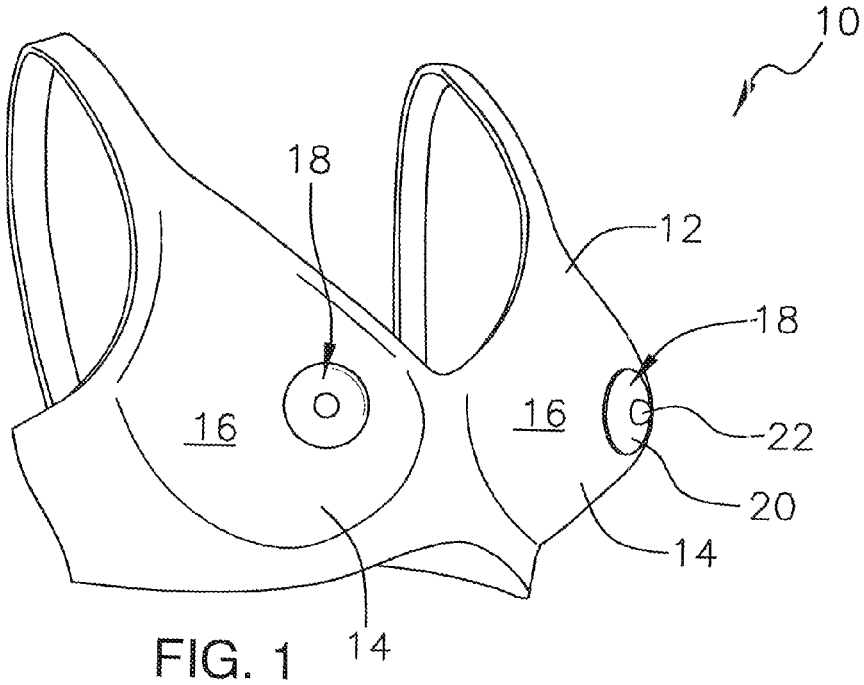
FIG. 1 is a top front side perspective view of a prosthetic nipple undergarment device according to an embodiment of the disclosure.
Figure 2:
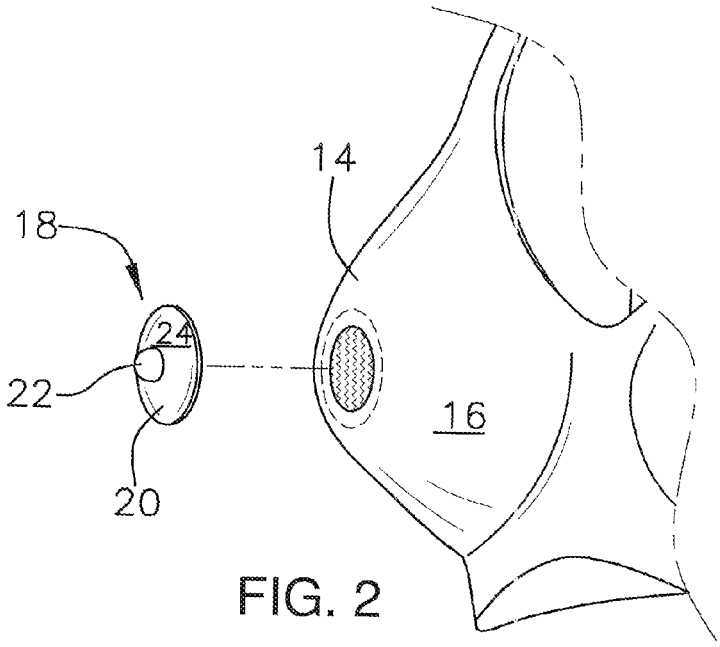
FIG. 2 is a partially exploded top front side perspective view of an embodiment of the disclosure.
Figure 3:
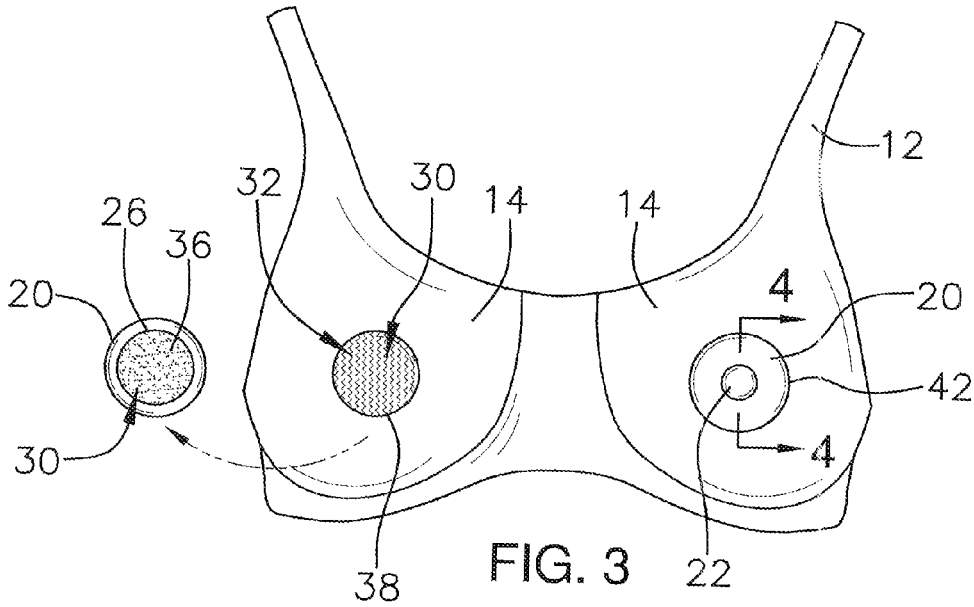
FIG. 3 is a partially exploded front view of an embodiment of the disclosure.
Figure 4:
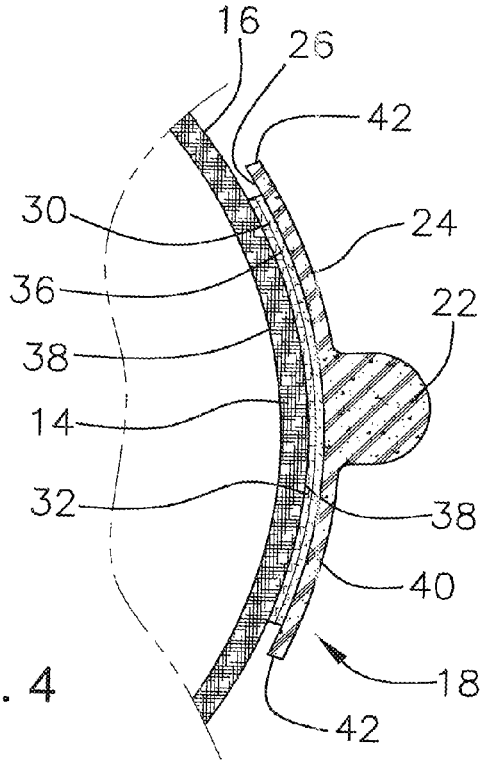
FIG. 4 is a cross-sectional view of an embodiment of the disclosure taken along line 4-4 of FIG. 3.
Figure 5:
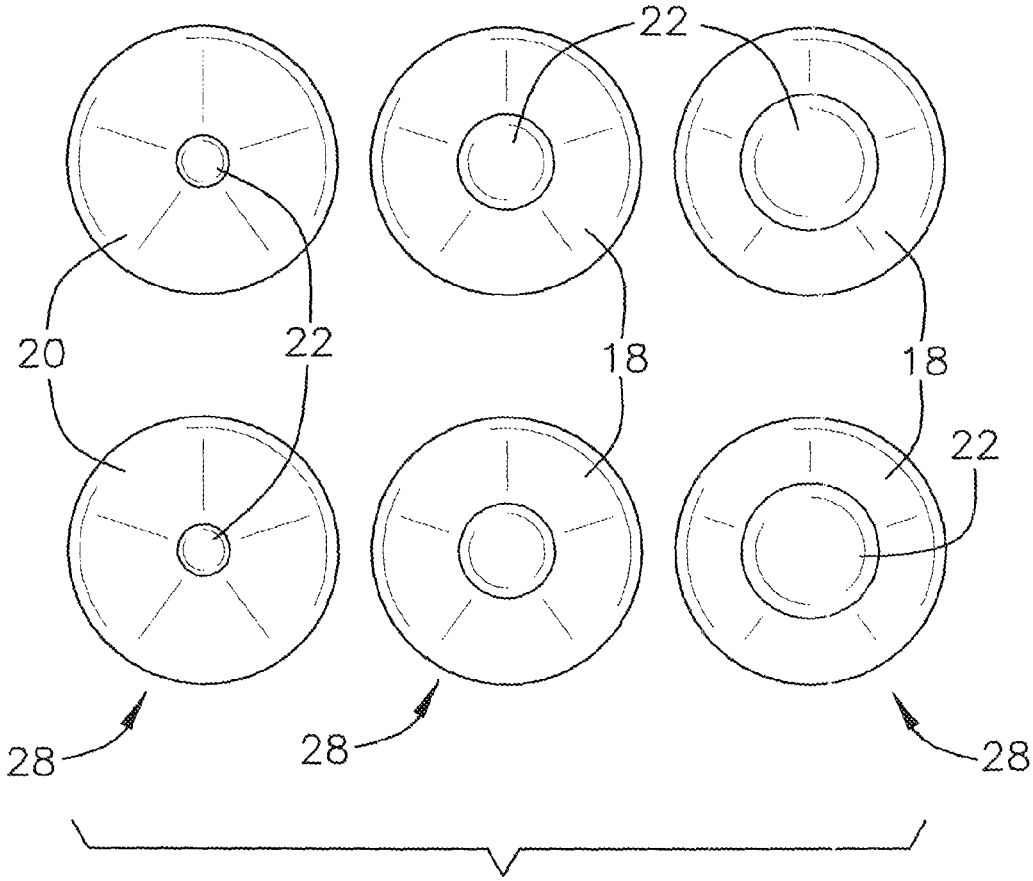
FIG. 5 is a front view of interchangeable prosthetic nipples of an embodiment of the disclosure.
Figure 6:
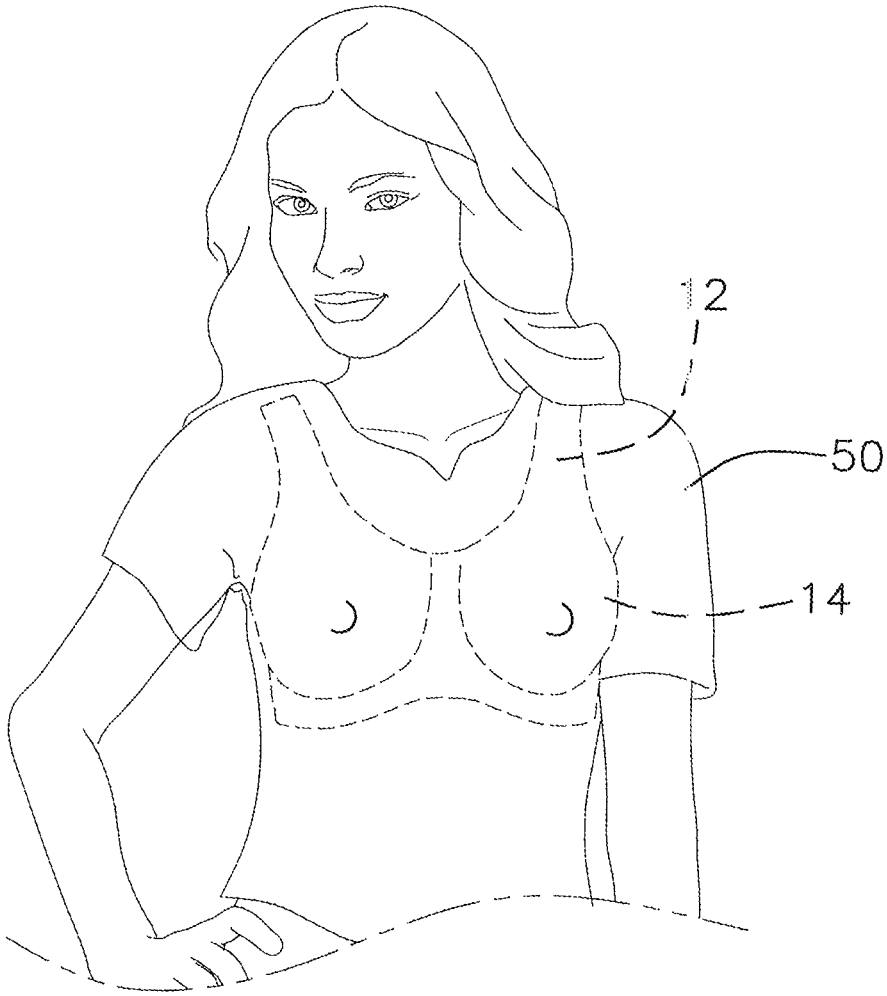
FIG. 6 is a front view of an embodiment of the disclosure in use.

With reference now to the drawings, and in particular to FIGS. 1 through 6 thereof, a new undergarment device embodying the principles and concepts of an embodiment of the disclosure and generally designated by the reference numeral 10 will be described.

As best illustrated in FIGS. 1 through 6, the prosthetic nipple undergarment device 10 generally comprises a brassiere 12 having a pair of breast receiving cups 14. Each cup 14 has an outer surface 16. Each of a plurality of prosthetic nipples 18 is selectively couplable to a selectable one of the cups 14. Each prosthetic nipple 18 may be constructed of an elastomeric material to provide a realistic feel and appearance. The prosthetic nipple 18 comprises a base 20 and a projection 22 coupled to and extending from the base 20 wherein the prosthetic nipple 18 is configured to resemble an erect human nipple. The base 20 has a convex outer surface 24. The projection 22 extends from the convex outer surface 24 of the base 20. The base 20 may also have a concave inner surface 26. The inner surface 26 couples to the cup 14. The prosthetic nipples 18 may provide for a plurality of substantially identical pairs 28 of the prosthetic nipples 18. Each prosthetic nipple 18 of the identical pair 28 is selectively couplable to a respective one of the cups 14 of the brassiere 12.

A fastener 30 may be coupled to each cup 14 to selectively remove and replace the prosthetic nipple 18 from the cup 14. The fastener 30 may be positioned on the outer surface 16 of the cup 14. The prosthetic nipple 18 is selectively couplable to the fastener 30 allowing a person to wear the brassiere 12 without a prosthetic nipple 18 if desired. The fastener 30 may be a first portion of hook and loop fastener 32 coupled to each cup 14 and a second portion of hook and loop fastener 36 coupled to the base 20 of each prosthetic nipple 18. The second portion of hook and loop fastener 36 is complementary to the first portion of hook and loop fastener 32 such that each prosthetic nipple 18 is interchangeable with each other prosthetic nipple 18 on any of the cups 14. The first portion of hook and loop fastener 32 may be loop fastener 38 to prevent snagging of the fastener 30 on a garment worn over the brassiere 12 without an attached prosthetic nipple 18. The fastener 30 is coupled to the outer surface 16 of the cup 14 and positioned between the outer surface 16 of the cup 14 and an inner surface 40 of the base 20 wherein an outer edge 42 of the base 20 is positioned in spaced relationship to the outer surface 16 of the cup 14 when the prosthetic nipple 18 is coupled to the cup 14. Thus, an outline of the prosthetic nipple 18 corresponding to a border of a human areola may be projected through a garment 50 worn by a user further highlighting the appearance of an erect nipple under the garment 50.

In use, a desirable size and shape of prosthetic nipples 18 is selected and the pair 28 is coupled to the cups 14 of the brassiere 12. The brassiere 12 is worn under the garment 50 providing the appearance of erect nipples under the garment.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A prosthetic nipple undergarment device comprising:

a brassiere having a breast receiving cup, said cup having an outer surface;

a prosthetic nipple selectively couplable to said cup, said prosthetic nipple comprising a base and a projection coupled to and extending from said base wherein said prosthetic nipple is configured to resemble an erect human nipple;

a fastener coupled to said cup, said fastener being positioned on said outer surface of said cup, said prosthetic nipple being selectively couplable to said fastener, said fastener being a first portion of hook and loop fastener; and a second portion of hook and loop fastener being coupled to said base of said prosthetic nipple, said second portion of hook and loop fastener being complementary to said first portion of hook and loop fastener.

2. The device of claim 1, further comprising:

said brassiere having a pair of said cups; and a plurality of said prosthetic nipples, each prosthetic nipple being selectively couplable to an associated one of said cups.

3. The device of claim 1, further comprising said first portion of hook and loop fastener being loop fastener.

4. The device of claim 1, further comprising said base having a convex outer surface, said projection extending from said convex outer surface of said base.

5. The device of claim 4, further comprising said base having a concave inner surface, said inner surface coupling to said cup.

6. The device of claim 2, further comprising said plurality of prosthetic nipples comprising a plurality of substantially identical pairs of said prosthetic nipples, each prosthetic nipple of said identical pair being selectively couplable to a respective one of said cups of said brassiere.

7. The device of claim 1, further comprising said fastener being coupled to said outer surface of said cup and positioned between said outer surface of said cup and an inner surface of said base wherein an outer edge of said base is positioned in spaced relationship to said outer surface of said cup when said prosthetic nipple is coupled to said cup.

8. The device of claim 1, further comprising said prosthetic nipple being constructed of an elastomeric material.

9. A prosthetic nipple undergarment device comprising:

a brassiere having a breast receiving cup, said cup having an outer surface, said brassiere having a pair of said cups;

a plurality of prosthetic nipples, each said prosthetic nipple being selectively couplable to a selectable one of said cups, said prosthetic nipple being constructed of an elastomeric material, said prosthetic nipple comprising a base and a projection coupled to and extending from said base wherein said prosthetic nipple is configured to resemble an erect human nipple, said base having a convex outer surface, said projection extending from said convex outer surface of said base, said base having a concave inner surface, said inner surface coupling to said cup, said plurality of prosthetic nipples comprising a plurality of substantially identical pairs of said prosthetic nipples, each prosthetic nipple of said identical pair being selectively couplable to a respective one of said cups of said brassiere; and a fastener coupled to each said cup, said fastener being positioned on said outer surface of said cup, said prosthetic nipple being selectively couplable to said fastener, said fastener being a first portion of hook and loop fastener coupled to each said cup and a second portion of hook and loop fastener coupled to said base of each said prosthetic nipple, said second portion of hook and loop fastener being complementary to said first portion of hook and loop fastener, said first portion of hook and loop fastener being loop fastener, said fastener being coupled to said outer surface of said cup and positioned between said outer surface of said cup and an inner surface of said base wherein an outer edge of said base is positioned in spaced relationship to said outer surface of said cup when said prosthetic nipple is coupled to said cup.

* * * * *